United States Patent [19]

Spears

[11] Patent Number: 4,860,641

[45] Date of Patent: Aug. 29, 1989

[54] VARIABLE STROKE COMPRESSOR SOCKET PLATE

[75] Inventor: Thomas D. Spears, East Amherst, N.Y.

[73] Assignee: General Motors Corporation, Detroit, Mich.

[21] Appl. No.: 223,329

[22] Filed: Jul. 25, 1988

[51] Int. Cl.[4] ..... F04B 1/18; F01B 29/00; B23D 15/00

[52] U.S. Cl. ..... 92/71; 92/128; 417/269; 29/156.5 A

[58] Field of Search ..... 74/60; 92/128, 71; 91/499, 507; 417/269; 29/156.5 A

[56] References Cited

U.S. PATENT DOCUMENTS

| | | | |
|---|---|---|---|
| 1,210,649 | 1/1917 | Jennings | 417/269 |
| 1,573,525 | 2/1926 | Sandoz | 74/60 |
| 1,886,770 | 11/1932 | Wehr | 74/60 |
| 1,966,619 | 7/1934 | Fick | 91/507 |
| 2,293,731 | 8/1942 | Frederickson | 74/60 |
| 3,495,543 | 2/1970 | Millard | 92/128 |
| 4,453,300 | 6/1984 | Klimek et al. | 29/156.4 |
| 4,480,964 | 11/1984 | Skinner | 417/222 |
| 4,505,016 | 3/1985 | Roberts | 29/156.5 |
| 4,548,254 | 10/1985 | Roberts | 164/112 |

*Primary Examiner*—William L. Freeh
*Attorney, Agent, or Firm*—R. L. Phillips

[57] ABSTRACT

A wobble plate of the type for operating in a variable displacement compressor including a plurality of pistons operatively connected to the wobble plate by a plurality of dumb-bell like piston rods having spherical end portions and a connecting rod extending therebetween. The wobble plate includes a plurality of sockets including an integral lip for retaining the spherical portion of the piston rods contained within each of the sockets against axial displacement and a passageway extending radially outwardly from each of the sockets and opening to a peripheral edge of the wobble plate for allowing insertion of the piston rods from a direction substantially perpendicular relative to the central axis of the wobble plate. Plugs disposed within the passageway prevent inadvertent radial displacement of the spherical ends of the rod members from the sockets.

5 Claims, 3 Drawing Sheets

VARIABLE STROKE COMPRESSOR SOCKET PLATE

TECHNICAL FIELD

The present invention relates to a variable displacement refrigerant compressor of the variable angle wobble plate type. More specifically, the present invention relates to a wobble plate and the means for connecting a plurality of piston rods thereto.

BACKGROUND ART

Refrigerant systems in vehicles generally include a refrigerant compressor lubrication system of the passive type with swash or wobble plate drive mechanisms using oil entrained in the refrigerant to lubricate the mechanisms critical bearing surfaces. An example of a refrigerant compressor lubrication system is disclosed in the U.S. Pat. No. 4,480,964 to Skinner, issued Nov. 6, 1984 and assigned to the assignee of the present invention. The assembly is of the type connected in an automotive air conditioning system having a normal condenser, orifice tube, evaporator, and an accumulator arranged in that order between the compressor's discharge and suction sides. Generally, the compressor includes a cylinder block having a head and a crank case sealingly clamped to opposite ends thereof. A drive shaft is supported centrally in the compressor at the cylinder block and crank case. The drive shaft extends through the crank case for connection to an automotive engine. The cylinder block includes a plurality of axial cylinders, a piston rod connecting a piston to a nonrotary ring shaped wobble plate received about the drive shaft through each of the cylinders. The end of each piston rod is connected to the wobble plate by a spherical rod end which is retained in a socket on the wobble plate by a split retainer ring which has a snap fit with the wobble plate. During operation of the assembly, reciprocation of the piston rods places stresses in the axial direction directly on the retainer rings. It is desirable to provide for the operation of the variable displacement compressor at higher RPM, however, there are inherent limitations on the stresses that can be placed on the retainer ring.

The U.S. Pat. No. 4,548,254 to Roberts, issued Oct. 22, 1985 discloses a method of manufacturing a swash plate assembly for use in a compressor. A plurality of ball ended rods have a pair of split die inserts positioned about the rod, each against one of the balls. The balls are positioned in a die having a central core to locate their position and which die securely maintains the inserts against each of the ball ends. A piston is cast about one ball end of the rod and the opposite ball end, which is positioned in a mating swash plate socket, has a swash plate cast about it. Tolerances for maximized performance are very difficult to obtain when casting about a ball end.

The present invention provides a socket plate, commonly referred to as wobble or swash plate, for allowing the operation of a variable stroke, variable displacement compressor at higher RPM.

SUMMARY OF THE INVENTION

In accordance with the subject invention, there is provided a wobble plate of the type for operating a variable stroke variable displacement compressor which can operate at higher rpm because the connecting piston rod is retained by an integral part of the plate.

More specifically, the present invention provides a wobble plate including a forward surface and a peripheral surface about the forward surface. A plurality of bores extend radially into the plate from the peripheral surface. Each of the bores include an inner socket portion and an outer passageway. The forward surface includes a slot extending radially inwardly from the peripheral surface. The slot defines a lip for retaining a spherical portion of a rod member within the socket portion. A plug plugs the outer passageway.

The present invention further provides a wobble plate designed in such a way that the connecting rod and piston can be inserted from the side of the wobble plate assembly in a direction perpendicular to the lines of axial force encountered by the wobble plate during operation, the piston rods being retained within the sockets by an integral part of the plate, as opposed to a retaining ring.

Further, the present invention provides a method of manufacturing a wobble plate and piston subassembly of a variable stroke variable displacement compressor including the steps of fixturing one end of a piston so that each connecting rod extending therefrom extends parallel relative to each other and parallel relative to a central axis, radially outwardly pivoting the free end of each rod, pivoting each of the rods radially inwardly towards the central axis while inserting the free end of each piston rod into a radially opening passageway of a socket of the wobble plate, and plugging the passageway of each of the sockets.

FIGURES IN THE DRAWINGS

Other advantages of the present invention will be readily appreciated a the same becomes better understood by reference to the following detailed description when considered in connection with the accompanying drawings wherein.

DETAILED DESCRIPTION OF THE DRAWINGS

Figure 1:
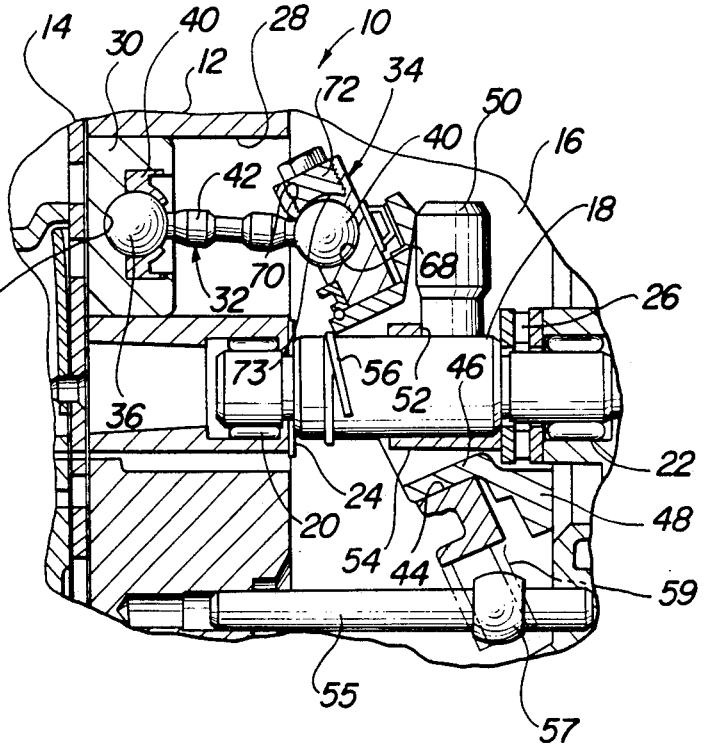
FIG. 1 is a cross sectional view of a variable displacement refrigerant compressor of the variable angle wobble plate type having incorporated therein the preferred embodiment of the present invention.

Referring to FIG. 1, there is shown a variable displacement refrigerant compressor generally indicated at 10 of the variable angle wobble plate type. The compressor is a variable stroke displacement compressor commonly connected in an automotive air conditioning system and having a normal condenser, orifice tube, evaporator, and an accumulator arranged in that order between the compressor's discharge and suction sides. The compressor 10 includes a cylinder block 12 having a head 14 and a crank case 16. A drive shaft 18 is supported centrally in the compressor 10 at the cylinder block 14 and crank case 16 by radial needle bearings 20,22, respectively, and is axially retained by a thrust washer 24 inward of the needle bearing 20 and a thrust needle bearing 26 inward of the radial needle bearing 22. The drive shaft 18 extends through the crank case 16 for connection to an automotive engine (not shown) by a clutch mechanism mounted on the crank case 16.

The cylinder block 12 has five axial cylinders 28 extending therethrough (only one being shown), which are equally angularly spaced and equally radially spaced from the axis of the drive shaft 18. The cylinders 28 extend parallel to the drive shaft 18. A piston 30 is mounted for reciprocal sliding movement in each of the cylinders 28. A separate piston rod, generally indicated at 32, connects the backside of each piston 30 to a nonrotary ring-shaped wobble plate generally indicated at 34, the wobble plate 34 being received about the drive shaft 18. Each of the piston rods 32 is connected to its respective piston 30 by a spherical rod end 36 which is retained in a socket 38 on the back side of the piston 30 by a retainer 40 that is swaged in place. The opposite end 40 of the piston rod 32 is connected to the wobble plate 34 pursuant to the present invention as discussed below. A rod portion 42 extends between the two spherical portions 36,40.

The nonrotary wobble plate 34 is mounted at it inner diameter 44 on a journal 46 of a rotary drive plate 48.

The drive shaft 18 is drivingly connected to the drive plate 48 by a lug 50 which extends freely through a longitudinal slot 52 in a sleeve 54 which is slideably mounted on the drive shaft 18. The connection is disclosed in more detail in the U.S. Pat. No. 4,480,964 to Skinner, issued Nov. 6, 1984 and assigned to the assignee of the present invention. The drive lug 50 guides the angularity of the drive plate 48 and wobble plate 34. The drive lug arrangement for the drive plate 48 and an anti-rotation guide arrangement for the wobble plate 34 are like that disclosed in greater detail in the U.S. Pat. Nos. 4,175,915 and 4,297,085, respectively assigned to the assignee of this invention and which are hereby incorporated by reference.

There is provided a split ring return spring 56 which is mounted in a groove on the drive shaft 18 and has one end that is engaged by the sleeve 54 during movement to the zero wobble angle position and is thereby conditioned to initiate return movement.

The wobble plate 34 while being angularable with the rotary drive plate 48 is prevented from rotating therewith by a guide pin 55. A ball guide 57 is slideably mounted and retained on the wobble plate within guide shoes 59 (only one being shown), the ball guide 57 being slideably mounted for reciprocal radial movement in the wobble plate 34.

Figure 2:
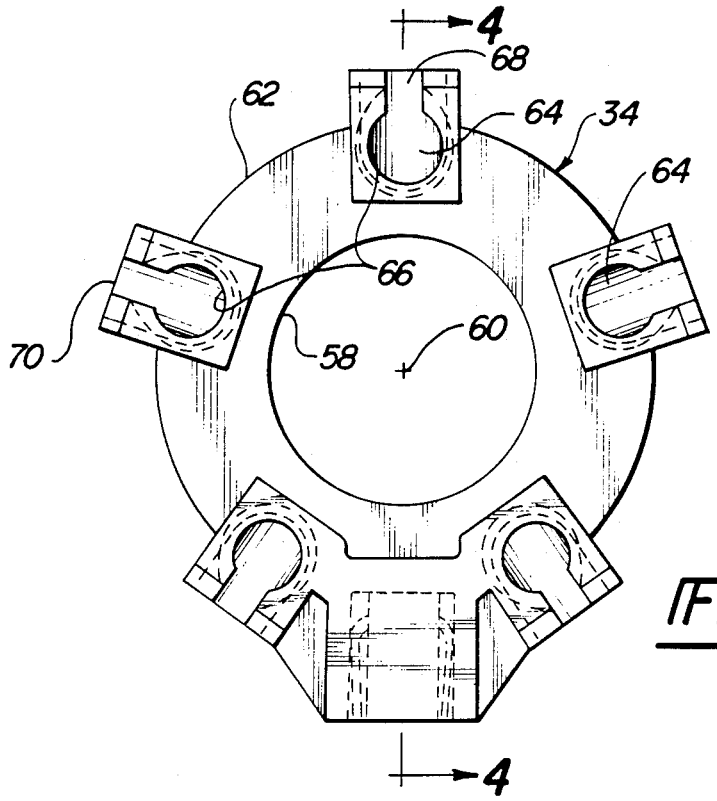
FIG. 2 is a plan view of a wobble plate constructed in accordance with the present invention.
Figure 3:
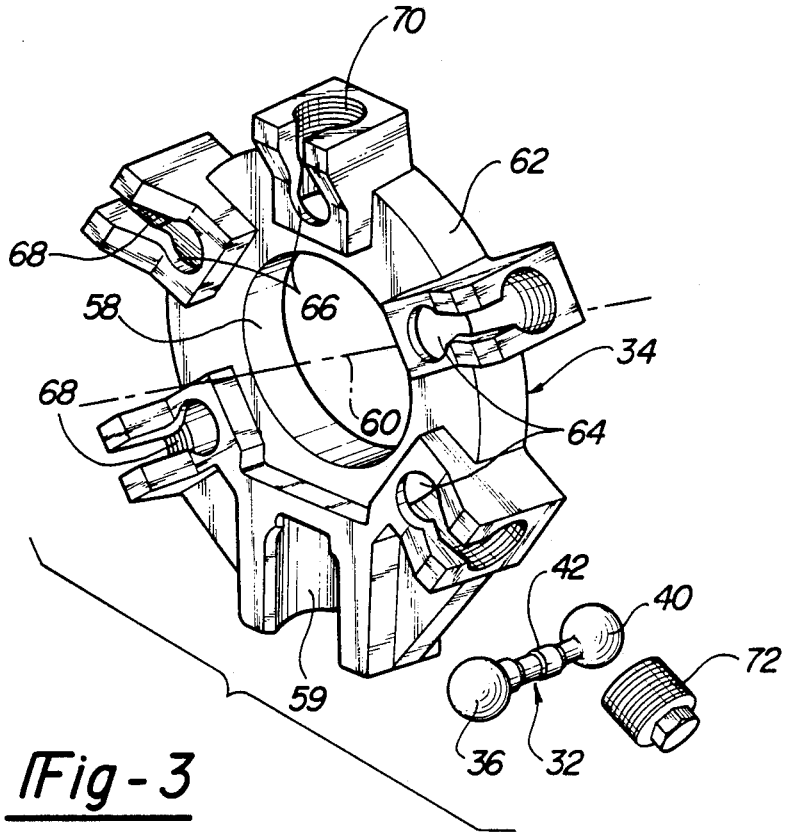
FIG. 3 is a perspective view of the present invention.
Figure 4:
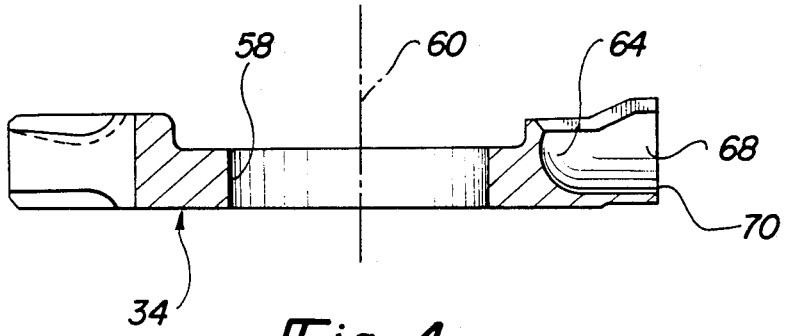
FIG. 4 is a cross sectional view taken substantially along lines 4—4 of FIG. 2.

The wobble plate 34 includes a central opening 58 defining a central axis schematically shown in FIGS. 2–4 at 60. The wobble plate 34 further includes a radially peripheral edge or outer surface 62.

The wobble plate 34 includes retaining means integral with the wobble plate defining a plurality of sockets 64. Each of the sockets 64 includes an integral lip 66 for retaining the spherical portion 40 of the piston rod 32 contained within each of the sockets 64 against axial displacement. A passageway 68 extends radially outwardly from each of the sockets 66 and opens to the peripheral edge 62 at 70. The passageway allows insertion of the piston rods 32 from a direction substantially perpendicular relative to the central axis 60.

Plugs 72 plug each of the passageways 70 and prevent inadvertent radial displacement of the spherical ends 40 of the rod members 42 from the sockets 68. Each plug 72 has a spherical inner surface 73 which contacts the spherical end 40 of the rod 32. The inner surface 73 provides more bearing surface and spreads out loading within the sockets.

Each of the sockets 68 have a substantially spherical inner surface, the lips 66 defining an opening in the surface in a direction parallel relative to the central axis 60. Each of the passageways 70 also includes an opening continuous with the first mentioned opening whereby the rod portions 42 of the piston rods 32 pass through the second opening during insertion of the piston rod 32 into the socket 68. The plugs 72 plug each of the passageways 70 and each of the second mentioned openings.

The plugs 72 are press fit into the passageways 70 and secured with either an adhesive or a heat stake. Alternatively, the plugs 72 could be threaded into the passageways 70. The plugs 72 can be made from steel, composites, or plastics. When made from steel, the plugs 72 can be welded in place. When made from composites or plastics, the plugs 72 can be vibration welded or sonically welded. Adhesives can also be used, keeping in mind that adhesives may require an extended cure time and must be kept out of the bearing surfaces.

In operation, the connecting rods 32 are retained against axial displacement by an integral part of the wobble plate 32. The spherical ball bearing end 40 of each of the piston rods 32 allow rotation or pivoting movement of the rods 32. The piston rods 32 are retained along the path of insertion by the plugs 72.

Figure 5:
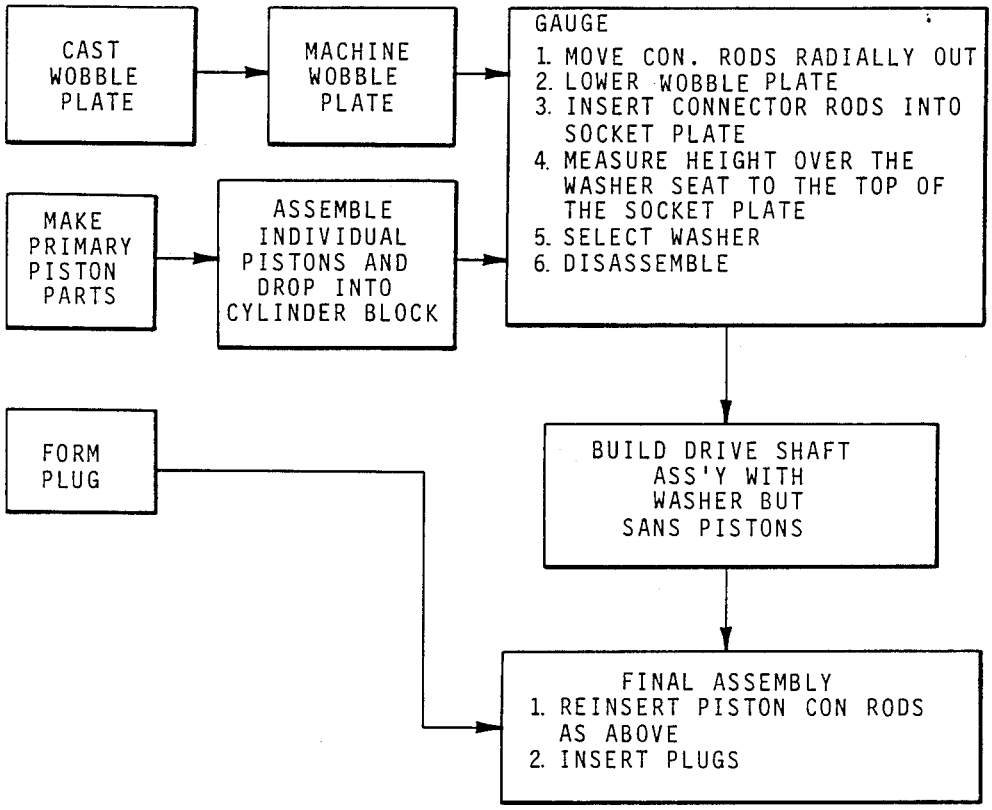
FIG. 5 is a low diagram of a method of manufacturing a wobble plate subassembly in accordance with the present invention.

The present invention further provides a method of manufacturing the wobble plate and piston subassemblies, schematically shown as a flow diagram in FIG. 5. Initially, the wobble plate 34 is cast by either die casting, the permanent mold method or equivalent casting technology. The insertion path or passageway 70 and socket 68 are machined to final dimensions by a ball pocket cutter. The plug 72 is manufactured by any one of a variety of techniques, including casting machining, stamping, or forging.

Two general operations are carried out during the manufacturing of the assembly. The present invention provides a novel method of gaging the wobble plate 34 as well as a novel method of manufacturing the compressor assembly. In the gaging operation, the bottom of the piston 30 is fixtured and the connecting piston rods 32 are rotated in the ball joint 38 formed in the piston 30. This procedure is performed for each piston rod 32 simultaneously as each piston rod 32 is moved radially outwardly away from the center of the wobble plate 34 to allow for insertion of the piston rods 32. The wobble plate 34 is lowered into position and the piston rods 32 are returned to their original positions as they are inserted into the passageways 70 in the wobble plate 34, eventually inserting the spherical portions 40 in the sockets 68.

When gaging is performed, all five of the pistons are generally held in the cylinder block or fixtured. The height over the washer seat to the top of the socket plate is measured. A single washer 24 is selected. The purpose of the washer 24 is to raise or lower the entire shaft assembly in order to allow the piston 32 to come as close as possible to the end of the cylinder block. This operation minimizes the amount of gas that expands within the cylinder 28 after the end of the piston stroke. The operation further maximizes the amount of fresh refrigerant drawn into the cylinder during each stroke. This optimizes the compressed volumetric efficiency.

Once the gaging is completed, the piston rods 32 are removed from the socket plate 34 and the entire drive shaft assembly is built, including the washer 24 which was selected during the gaging operation. Finally, the drive shaft assembly is inserted into the cylinder head. Again, the piston rods 32 are tilted radial outwardly and then inserted into the socket plate 34 for the second time, followed by the insertion of the plugs.

The present method provides a wobble plate assembly wherein spherical ends of piston rods are secured within sockets of the wobble plate while not requiring casting of the wobble plate about the spherical rods.

The invention has been described in an illustrative manner, and it is to be understood that the terminology which has been used is intended to be in the nature of words of description rather than of limitation.

Obviously, many modifications and variations of the present invention are possible in light of the above teachings. It is, therefore, to be understood that within the scope of the appended claims the invention may be practiced otherwise than as specifically described.

What is claimed is:

1. A wobble plate of the type for operating a variable stroke variable displacement compressor comprising a forward surface and a peripheral surface about said forward surface, the improvement comprising a plurality of bores extending radially into said plate from said peripheral surface, each of said bores including an inner socket portion and an outer passageway, said forward surface including a slot extending radially inwardly from said peripheral surface, said slot defining a lip for retaining a spherical portion of a rod member within said socket portion and plug means for plugging said outer passageway.

2. A wobble plate as set forth in claim 1 wherein said plug has a convex inner surface forming a portion of said socket.

3. A variable displacement refrigerant compressor of the variable angle wobble plate type having a crank case containing a drive plate and a wobble plate supported on said drive plate, at least one piston operatively connected to said wobble plate, the improvement comprising a rod extending from said piston and having a spherical end portion, said wobble plate including a peripheral surface and a forward surface facing said piston and at least one bore extending radially into said plate from said peripheral surface, said bore including an inner socket portion and an outer passageway, said forward surface including a slot extending radially inwardly from said peripheral surface, said slot defining a lip for retaining said spherical portion within said socket portion and plug means for plugging said outer passageway.

4. A method of manufacturing a wobble plate and piston subassembly of a variable stroke displacement compressor including the steps of: fixturing at least one piston including a rod extending therefrom so that the rod extends parallel relative to each a central axis of the compressor; radially outwardly pivoting the free end of the rod; pivoting the rod radially inwardly towards the central axis while inserting the free end of the rod into a radially opening passageway of a socket of the wobble plate; and plugging the passageway of the socket.

5. A method as set forth in claim 4 wherein the wobble plate includes a top surface, said method further including the steps of assembling the wobble plate and piston into a cylinder block including a washer seat prior to plugging the passageway of the socket, gauging the washer seat relative to the wobble plate, selecting a washer for insertion on the washer seat to allow the pistons to move as close as possible to the end of the cylinder block, removing the piston rod from the socket seating the washer on the washer seat, and reinserting the piston rod into the socket and plugging the passageway of the socket.

* * * * *